US005760539A

United States Patent [19]

Park

[11] Patent Number: 5,760,539

[45] Date of Patent: Jun. 2, 1998

[54] CRT HAVING A PANEL WITH A SMALLER EFFECTIVE AREA AND STRAIGHT OUTLINES

[75] Inventor: Young Ho Park, Gumi-si, Rep. of Korea

[73] Assignee: Orion Electric Co., Ltd., Kyungsangbuk-do, Rep. of Korea

[21] Appl. No.: 619,503

[22] PCT Filed: Jul. 29, 1995

[86] PCT No.: PCT/KR95/00094

§ 371 Date: Jun. 25, 1996

§ 102(e) Date: Jun. 25, 1996

[87] PCT Pub. No.: WO96/04673

PCT Pub. Date: Feb. 15, 1996

[30] Foreign Application Priority Data

| | | | |
|---|---|---|---|
| Jul. 30, 1994 | [KR] | Rep. of Korea | 1994-18887 |
| Sep. 26, 1994 | [KR] | Rep. of Korea | 1994-24152 |
| Sep. 30, 1994 | [KR] | Rep. of Korea | 1994-25339 |

[51] Int. Cl.[6] ..... H01J 29/10

[52] U.S. Cl. ..... 313/461; 313/463; 313/477 R

[58] Field of Search ..... 313/461, 463, 313/473, 477 R

[56] References Cited

U.S. PATENT DOCUMENTS 4,675,571 6/1987 Bakker et al. ..... 313/461

*Primary Examiner*—Sandra L. O'Shea
*Assistant Examiner*—Vip Patel
*Attorney, Agent, or Firm*—Jacobson, Price, Holman & Stern, PLLC

[57] ABSTRACT

In a color cathode-ray tube, the effective area of the panel is formed to be smaller than panel projected area of the apertured area of the shadow mask. The effective area of the panel having straight outlines and right-angled corners to form a rectangular shape, and each of apexes thereof coincides with that of the panel projected area. To obtain the above rectangular effective area, the present invention adopts means for restricting exposing extent between the light source and the panel, in the exposure of black matrix (FIG. 6).

4 Claims, 6 Drawing Sheets

CRT HAVING A PANEL WITH A SMALLER EFFECTIVE AREA AND STRAIGHT OUTLINES

TECHNICAL FIELD

The present invention relates to a color cathode-ray tube, and particularly to a color cathode-ray tube having a novel structure and a method appropriate for manufacturing the same.

BACKGROUND ART

A color cathode-ray tube is an apparatus for displaying a color image, in which three red, green, blue (R,G,B) phosphors are respectively arranged in a prescribed pattern to form a screen, and each phosphor selectively emits light by means of an electron beam.

Referring to FIG. 1, there is depicted a typical structure of the screen of a color picture tube. On the inner surface of a panel P, black matrix B is applied for enhancing the contrast excluding windows in the form of stripes or dots, and each phosphor R,G,B is successively applied in windows of the black matrix B. Remaining symbol A designates the metal back for forming a mirror surface, and I is an intermediate layer.

As the above described screen should be formed in a fine pitch, photo lithography is generally adopted as described in FIG. 2.

Referring to FIG. 2, a slurry of black matrix B or phosphor R,G,B, including photo resist, is applied on the inner surface of a panel P in a thin layer. The panel P is placed on an exposing table, with a mask frame MF mounted in the inner side thereof as an exposure mask. The mask frame MF is formed by supporting a shadow mask M, the color selecting, means, to a frame F. Light emitted from a light source S is compensated by a compensating lens L and exposes the applied layer of the inner surface of the panel P in a prescribed pattern determined by the shadow mask M. And the finished panel P is developed to form functional layers as in the above pattern.

These procedures are repeated four times for the black matrix B and each of phosphors R,G,B to complete the panel as shown in FIG. 3. In FIG. 3, the screen of the panel P can be divided into a non-effective area Pn only with the black matrix B, and an effective area having phosphor R,G,B between the black matrix B to form an image.

To compensate for the difference in distances from the center of emission of the electron beam to the central part and the circumferential part, the panel P is formed in a shape of a curved surface having prescribed curvatures respectively to the horizontal, vertical and the diagonal axis. And the shadow mask M also formed in a curved surface to maintain a prescribed gap, namely the Q value, with the screen of the panel P.

The shadow mask M can be divided into an apertured area having color selecting apertures to form the effective area Pe of the panel P, and a non-apertured area having no apertures to correspond to the non-effective area Pn of the panel P.

As the shadow mask M has the curved surface, the outline O of the effective area Pe projected on the panel P, forms the outwardly convex curved line even in the case of the outline, of the apertured area to be straight. As the result, the shape of the effective area Pe is defined by four lines O and four corner portions C, each of outlines O meeting together thereat and being rounded for continuity's sake.

Referring to FIG. 4, there is depicted a tube mounted in the casing of a television set or a monitor. As the outline O' of the bezzel cover Z of the casing is nearly straight, a part of the non-effective area Pn is exposed at the corner portion C,C' and the outline O of the panel P is covered by the outline O' ot the bezzel cover Z at the intermediate part of the screen, thereby extremely exposing the effective area Pe in the bezzel cover Z.

As the result, a appearance of the finished display is not good, and the screen cannot be extremely utilized. Moreover, excessive heat is radiated and severe doming occurs, as the electron beam exposes the whole effective area Pe, which is larger than the area to actualy display the image.

This screen structure deteriorates the accuracy and reliability of data, especially in the CDP which takes data through the screen. To prevent these problems the outline of the shadow mask M is generally formed to be inwardly concave for the CDT, which causes many problems in the forming of the shadow mask M.

Recently, a Flat Square Tube as shown in FIG. 5 is suggested, the tube reduces the curvature of the panel P to be flat and forms four corners C which nearly are right angles, thereby making the effective area Pe almost rectangular.

The Flat Square Tube, however, requires a new panel P and a shadow mask M which are different from those of previously known tube, and the flat panel P thereof a wholly redesigned and separately produced electron gun assembly, deflection means, and compensating means. Moreover, the compensation of the convergence and others tend to be highly difficult as the difference of distances from the emission center of the gun to the central part and circumferential part of the panel P.

And the shadow mask is also used as an exposure mask even in the Flat Square Tube, thus the change of the exposure pattern due to the occurence of doming of the shadow mask by the high heat from the light source, and the resultant deterioration of the color purity cannot be prevented.

DISCLOSURE OF THE INVENTION

It is therefore an object of the present invention to provide a color cathode-ray tube having a rectangular effective area as that of Flat Square Tube, through utilizing components and procedures for a general tube just as they are.

It is another object of the present invention to provide an appropriate method for manufacturing the above described color cathode-ray tube, in which a rectangular effective area can be achieved through components and procedures for a general tube just as they are, and the heat deformation problem of the shadow mask during the exposure process can be resolved.

A color cathode-ray tube to achieve the primary object of the present invention, is characterized in that:

the projected area of the apertured area of the shadow mask on the panel, is larger than the effective area of the panel.

According to one aspect of the present invention, the apex of the corner portion of the prejected area of the apertured area on the panel coincides with that of the effective area of the panel, and the effective area has almost a rectangular shape.

According to another aspect of the present invention, phosphor is applied on the projected area of the apertured area of the shadow mask on the panel, and the outline of the effective area is confined by the black matrix.

In a typical color cathode-ray tube, the projected area of the apertured area of the mask, the window forming part of the black matrix and the phosphor applied part all coincide with each other, as striped or dotted windows are formed at the effective area of the panel, and phosphor are applied on these windows. In contrast, the window forming part is smaller than the phosphor applying part, namely the panel projected area of the apertured area of the shadow mask according to the present invention, to restrict the size and shape of the effective area.

As the result, a rectangular effective area can be obtained with components of a conventional color cathode-ray tube.

A method for manufacturing the above described color cathode-ray tube, is characterized in that:

the black matrix is exposed with means for restricting the exposure extent; and the phosphor is exposed after removing the above restricting means.

Restricting means can be embodied in an auxilliary mask mounted on the shadow mask, a restriction plate mounted in the light path of the exposing light, or in a restriction filter mounted on the lens system.

According to the present invention, heat deformation problems of the shadow mask can be remedied to form a rectangular effective area of the panel while adopting conventional procedures of a general color cathode-ray tube just as it is.

BRIEF DESCRIPTION OF DRAWINGS

These and other objects and advantages will be more apparent from the following detailed description with reference to the accompanying drawings, in which.

MODES FOR CARRYING OUT THE INVENTION

Figure 1:
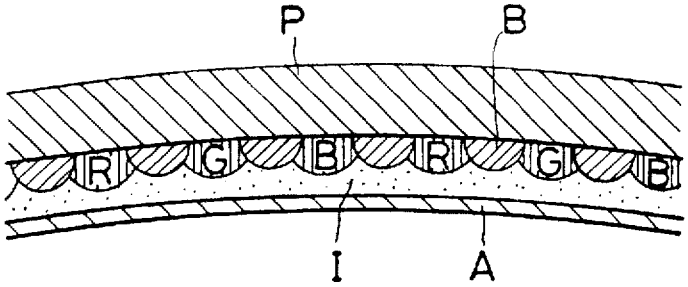
FIG.1 (PRIOR ART)
FIG. 1 is a sectional view depicting the structure of the phosphor screen of a typical color cathode-ray tube.
Figure 2:
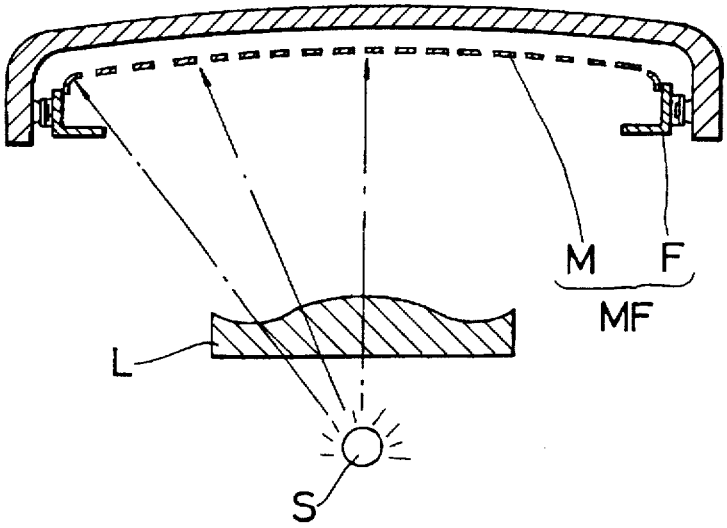
FIG.2 (PRIOR ART)
FIG. 2 is a sectional view illustrating the production procedure of a tube by the photo lithography.
Figure 3:
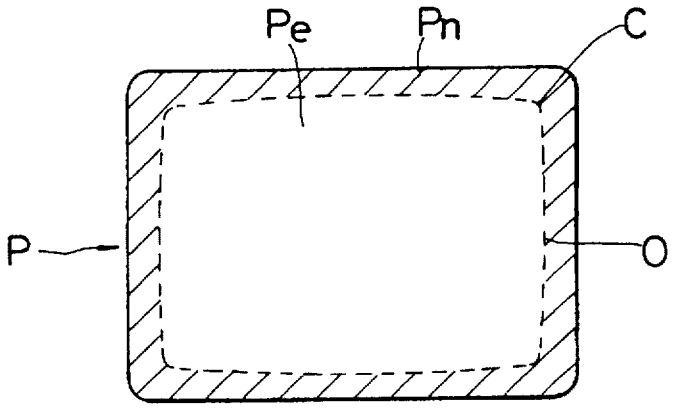
FIG. 3 (PRIOR ART)
FIG. 3 is a front view of the screen of a conventional color cathode-ray tube.
Figure 6:
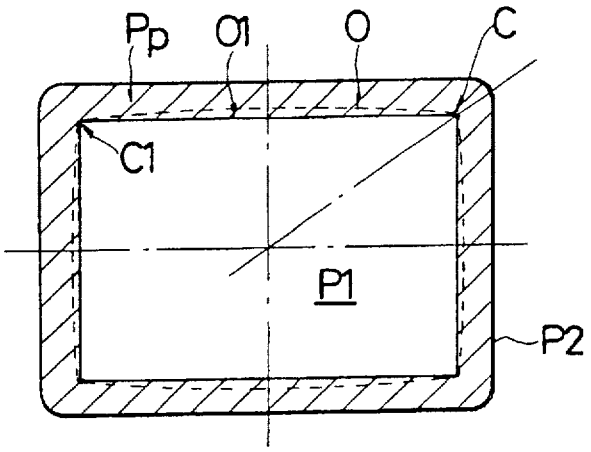
FIG. 6 is a front view of a color cathode-ray tube according to the present invention.

Referring to FIG. 6, a panel projected area Pp, the area formed by projecting a light source S through the shawdow mask M and compensating lens L, is shaped along with the broken line according to the present invention. The panel projected area Pp corresponds to the effective area Pe of the conventional tube shown in FIG. 3, and has same size and shape, namely the same outline O and corner portions.

According to the present invention, black matrix B hides inner edges of the panel projected area Pp to form a rectangular effective area P1. As the result, the effective area P1 has straight outlines O1 and corner portions C1 of right angles.

Figure 4:
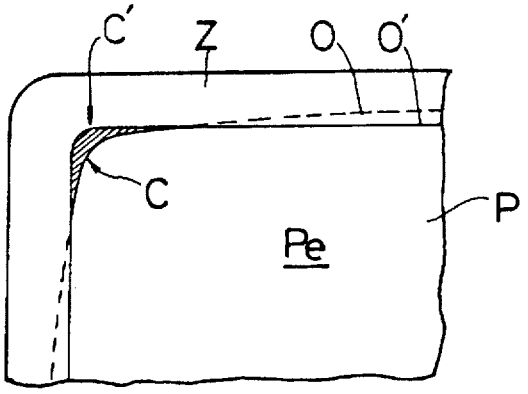
FIG. 4 (PRIOR ART)
FIG. 4 is a partially enlarged front view showing the tube being mounted in a casing.
Figure 5:
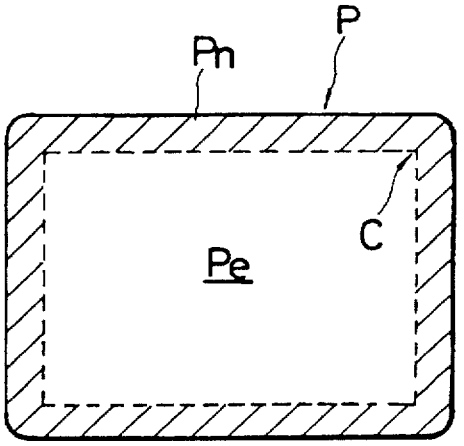
FIG. 5 (PRIOR ART)
FIG. 5 is a front view of a Flat Square Tube.

In other words, windows of the black matrix B are formed not all over the panel projected area Pp as in the conventional tube, but only on the effective area P1, thus making, as shown in FIG. 4, crescent shaped shaded portions between the panel projected area Pp and the effective area P1.

In the shaded portions, each of R,G,B phosphor is applied thereon in succession with the effective area P1, it consists of a part of non-effective area P2 as it is covered by black matrix B.

As a part of the panel projected area Pp of the apertured area of the shadow mask M, is covered by black matrix, the effective area P1 is to be smaller than the panel projected area Pp. According to the present invention, outwardly convexed outlines O of the conventional effective area Pe (equal to the panel projected area Pp) is trimmed by black matrix to form a rectangular shaped effective area P1.

It is preferable to make the four apexes of corner portions C of the panel projected area Pp coincide with those of the effective area P1. When apexes of the effective area P1 are located at the inner side of those of the panel projected area Pp, the size of the screen is reduced. And in the opposite case the corner protions C1 are rounded.

Figure 7:
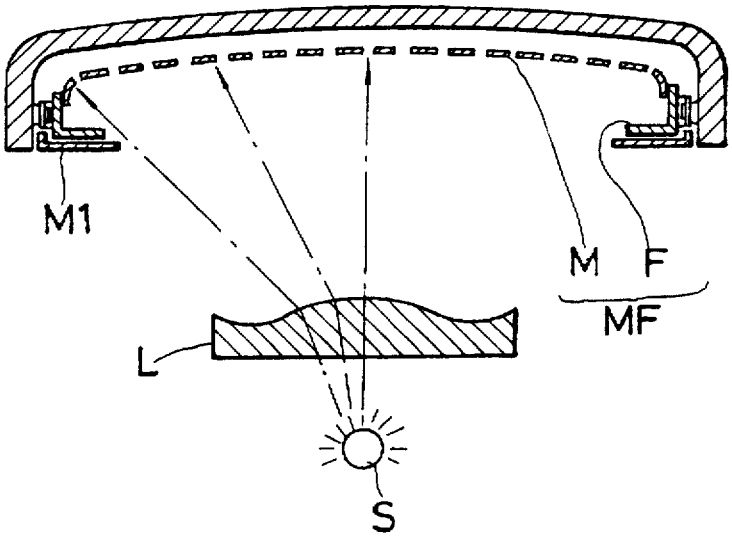
FIG. 7 is a sectional view of an exposure mechanism to produce the tube according to the present invention.

The present color cathode-ray tube can preferably be manufactured as shown in FIG. 7.

In FIG. 7, an auxilliary mask M1 is adopted as means for restricting the exposure extent. Black matrix B is exposed through a shadow mask M coupled with the auxilliary mask M1 having a window W for restricting the extent of the exposure, and phosphors R,G,B are exposed without the auxilliary mask M1.

As the result, windows of the black matrix B are formed on the part restricted by the window W of the auxilliary mask M1, and phosphors R,G,B is applied on the part corresponding to the panel projected area Pp of the shadow mask M and the outer portion thereof is covered by black matrix B to form a rectangular effective area P1.

In the drawing, the auxilliary mask M1 is depicted to be formed in the shape of a rim capable of projecting a rectangular effective area, and is coupled to the rear of the frame F of the mask frame MF. It can be, however, coupled to the front of the shadow mask M, and be formed as a transparent plate located on the face plate (not shown) of the exposure table on which the panel P is placed. The transparent plate can be made from glass or synthetic resin to have an opaque layer located outside of the periphery of the effective area P1 for restricting the exposure extent. The auxilliary mask M1 can also be formed on an opaque tape adhered to the face of the shadow mask M in the exposure of black matrix B, and the phosphors R,G,B are exposed after detaching the tape.

Figure 8:
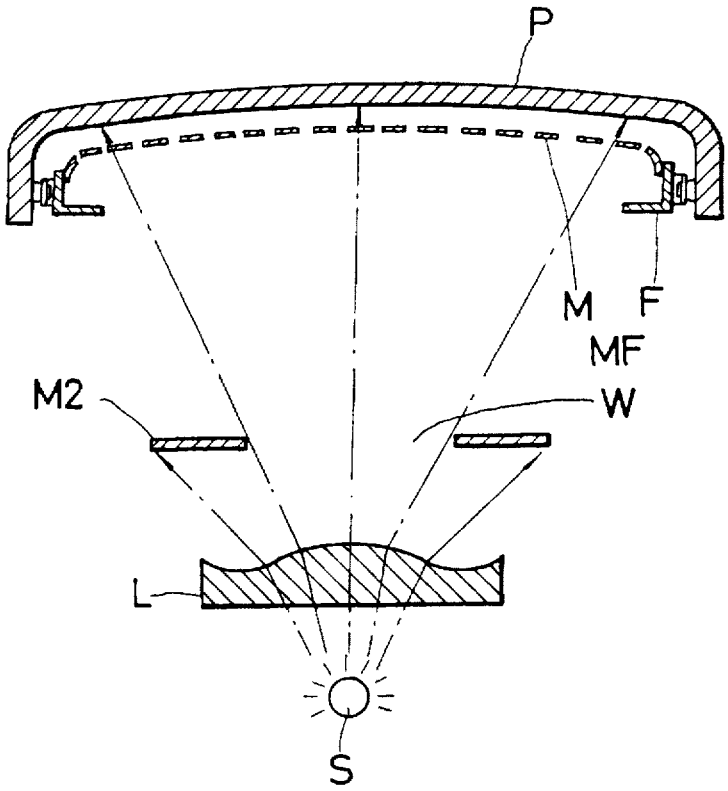
FIG. 8 is a sectional view according to another method of the present invention.
Figure 9:
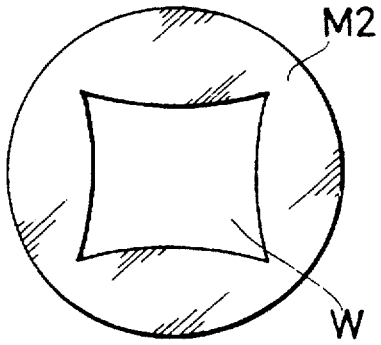
FIG. 9 is a plan view of a restriction plate utilized in the method shown in FIG. 8.

Means for restricting the exposure extent can be embodied in various forms, the method illustrated in FIGS. 8 and 9 adopts a restriction plate M2 mounted in the light path of the exposure light.

Referring to FIG. 8, a panel P being applied by black matrix and coupled with the mask frame MF is placed on the exposure table, and the exposing light generated from a light source S is projected through a compensating lens L. In the path of the exposing light, a restriction plate M2 is mounted to restrict the extent of the exposure according to the present invention. The restriction plate M2 has an inwardly concaved pin-cushion shaped window W as shown in FIG. 9 to make the light from the source S have the rectangular outline O1 as shown in FIG. 6.

After forming black matrix B with the above restriction plate M2, phosphor is formed without the plate M2 to obtain the phosphor screen as shown in FIG. 6 as a result.

Figure 10:
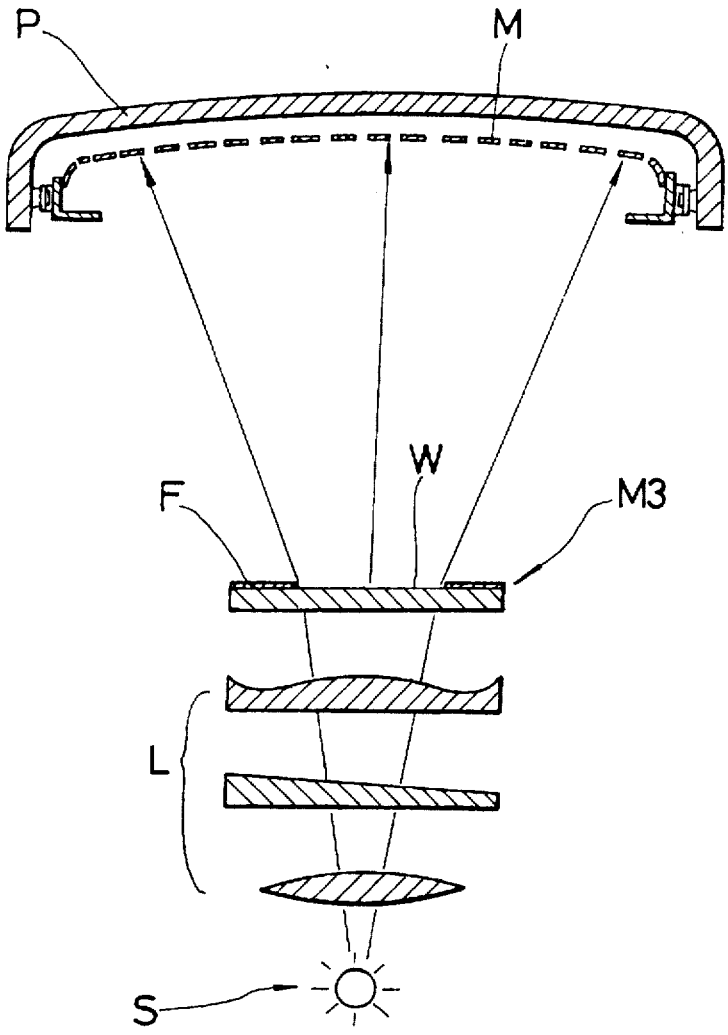
FIG. 10 is a sectional view according to still other method of the present invention.
Figure 11:
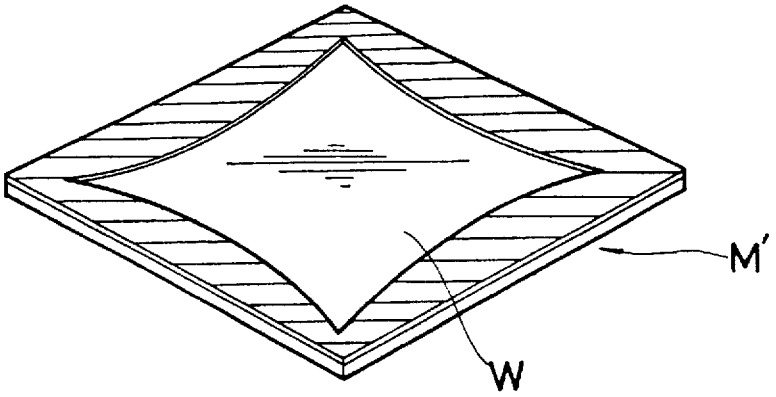
FIG. 11 is a perspective view showing the restriction filter utilized in the method shown in FIG. 10.

In the method illustrated, in FIGS. 10 and 11, a restriction filter M3 mounted on the lens system L is adopted as means for restricting the exposure extent.

Referring to FIG. 10, a panel P being applied with black matrix and coupled with the mask frame MF, is placed on the exposure table, and the exposing light from the light source S is projected after being compensated its pattern through the lens system L. In the lens system L, a restriction filter M3 is mounted to restrict the exposure extent according to the present invention. The restriction filter M3 has an inwardly concaved pin-cushion shape window W to confine the light projected from the light source to have the rectangular outline O1 as shown in FIG. 6. The restriction filter M3 can be formed by partially coating an opaque layer F on a glass substrate, and can be formed by a metal sheet in which the window W is cut out.

After forming black matrix with the restriction filter M3, phosphor is exposed without the filter M3 to result in the phosphor screen shown in FIG. 6. In general, the exposure of black matrix and phosphor are separately advanced at separate exposure tables, thus the above described method means the exposure extent restricting means M1~M3 is mounted only on the exposure table of the black matrix.

Figure 12:
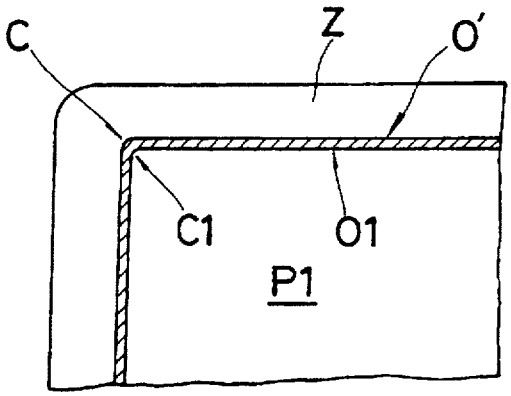
FIG. 12 is a front view showing the present tube mounted in the casing.

In FIG. 12, there is illustrated the present color cathode-ray tube manufactured as above, to be installed in the casing. In the drawing, the outline O1 of the effective area P1 is formed in straight line parallel with the outline O' of the bezzel cover Z, and the right-angled corner portion C1 thereof corresponds to the corner portion C' of the bezzel cover Z.

As described above, a rectangular screen can be obtained through adopting components and procedures of conventional color cathode-ray tube just as they are, without separately designing or producing them. This provides a color cathode-ray tube of a neat appearance and exact handling of data, without excessive additional production cost.

Moreover, the applied area of black matrix is relatively larger than the scanning area of the electron beam, thus the heat is well discharged to restrain the occurence of doming in operation. And the thermal deformation of the shadow mask is also suppressed during the exposing procedure to improve the quality of the phosphor screen.

I claim:

1. A color cathode-ray tube comprising a phosphor screen formed on an inner surface of a panel through successive photo lithography of black matrix and each phosphor by use of a color selecting shadow mask as an exposure mask, wherein an effective area of said panel is smaller than a projected area of an apertured area of said shadow mask to said panel.

2. A color cathode-ray tube according to claim 1, wherein each apex of corner portions of said effective area coincides with each corner portion of said panel projected area.

3. A color cathode-ray tube according to claim 1, wherein said effective area has a rectangular shape.

4. A color cathode-ray tube according to claim 1, wherein said phosphor is applied on said panel projected area; and said black matrix covers a part of said panel projected area to form said effective area of a prescribed shape.

* * * * *